United States Patent [19]

Kimoto et al.

[11] Patent Number: 4,968,579

[45] Date of Patent: Nov. 6, 1990

[54] ORGANIC LAMINATED PHOTOSENSITIVE MATERIAL OF POSITIVE CHARGING TYPE AND PROCESS FOR PREPARATION THEREOF

[75] Inventors: Keizo Kimoto, Sakai; Masashi Tanaka, Izumi-Ohtsu; Hirotsugu Nishikawa, Osaka, all of Japan

[73] Assignee: Mita Industrial Co., Ltd., Osaka, Japan

[21] Appl. No.: 504,104

[22] Filed: Apr. 4, 1990

[30] Foreign Application Priority Data

Jul. 31, 1987 [JP] Japan ..... 62-190168

[51] Int. Cl.[5] ..... G03G 5/06; G03G 5/14

[52] U.S. Cl. ..... 430/134; 430/135; 430/58

[58] Field of Search ..... 430/134, 58, 135

[56] References Cited

U.S. PATENT DOCUMENTS 4,490,452 12/1984 Champ ..... 430/58

4,727,009 2/1988 Takai ..... 430/58

*Primary Examiner*—J. David Welsh

*Attorney, Agent, or Firm*—Sherman and Shalloway

[57] ABSTRACT

Disclosed is an organic laminated photosensitive material of the positive charging type comprising an electroconductive substrate, a charge-transporting layer formed on the substrate and a charge-generating and transporting layer formed on the charge-transporting layer. The charge-transporting layer is composed of a binder resin containing a hole-transporting substance, and the charge-generating and transporting layer is composed of a binder resin containing a hole-transporting substance different from the hole-transporting substance in the charge-transporting layer and a charge-generating substance. The oxidation potential of the hole-transporting substance in the charge-generating and transporting layer is higher than that of the hole-transporting substance in the charge-transporting layer, but the difference of the oxidation potential between the hole-transporting substances of the two layers is smaller than 0.3 eV. In this photosensitive material, injection of holes between the two layers can be easily performed, and the sensitivity can be highly improved.

1 Claim, 1 Drawing Sheet

ORGANIC LAMINATED PHOTOSENSITIVE MATERIAL OF POSITIVE CHARGING TYPE AND PROCESS FOR PREPARATION THEREOF

BACKGROUND OF THE INVENTION

2. Field of the Invention

The present invention relates to an organic laminated photosensitive material of the positive charging type and a process for the preparation thereof. More particularly, the present invention relates to an organic laminated photosensitive material of the positive charging type having an excellent sensitivity and a process for the preparation thereof.

2. Description of the Prior Art

A photosensitive material for electrophotography comprising an electroconductive substrate and a layer of an inorganic or organic photoconductor formed on the substrate has been widely used. Representative of this photosensitive material, there is known a so-called function-separated organic photosensitive material in which a charge-generating substance and a charge-transporting substance are combined by lamination or dispersion.

Most of known function-separated organic photosensitive materials are of the negative charging type, but photosensitive materials of the negative charging type involve a problem in that ozone is generated at the time of charging. Accordingly, organic photosensitive materials of the positive charging type are eagerly desired.

As the organic photosensitive material of the positive charging type, there is known an organic photosensitive material comprising a charge-generating layer laminated on a charge-transporting layer having a hole-transporting property. In the organic photosensitive material, if the thickness of the carrier-generating layer is not reduced, injection of charges is not sufficiently performed, and if the thickness of the charge-generating layer is reduced, the abrasion resistance is poor and the printing resistance is degraded.

As means for overcoming this defect, Japanese Patent Application Laid-Open Specification No. 92962/87 discloses a photosensitive material comprising a carrier-generating layer (charge-generating layer) comprising anthanthrone bromide as the carrier-generating substance, a carrier-transporting substance and a binder resin. In this photosensitive material, the same substance is commonly used as the hole-transporting substance in the charge-generating and transporting layer and the hole-transporting substance in the charge-transporting layer.

This known photosensitive material is significant in that by incorporating the charge-transporting substance in the charge-generating layer, injection of holes in the charge-transporting layer can be performed smoothly even if the topmost charge-generating layer is relatively thick. However, if the same substance is used as the hole-transporting substance in the charge-generating and transporting layer and the hole-transporting substance in the charge-transporting layer, when the charge-generating and transporting layer is formed by coating, dissolution of the hole-transporting substance of the lower charge-transporting layer into the coating liquid for the upper layer cannot be avoided and the concentration of the hole-transporting substance in each of the charge-transporting layer and the charge-generating and transporting layer cannot be strictly controlled. Especially in the case where the charge-generating and transporting layer is formed by the dip coating method, the dissolution of the hole-transporting substance of the lower layer is very disadvantageous for controlling the concentration of the coating liquid.

Whether it is easy or difficult to inject holes between the charge-generating and transporting layer and the charge-transporting layer has serious influences on the sensitivity of the final photosensitive material, and the standard for selection of the hole-transporting substances based on the easiness of injection of holes has not been established.

SUMMARY OF THE INVENTION

It is therefore a primary object of the present invention to provide an organic laminated photosensitive material of the positive charging type comprising an electroconductive substrate, a charge-transporting layer formed on the substrate and a charge-generating and transporting layer formed on the charge-transporting layer, in which hole-transporting substances of the charge-transporting layer and the charge-generating and transporting layer are different from each other, injection of holes between both the layers can be performed easily and the sensitivity is increased.

Another object of the present invention is to provide an organic laminated photosensitive material in which dissolution of the hole-transporting substance of the lower charge-transporting layer is prevented at the time of formation of the upper charge-generating and transporting layer, whereby the concentration of the hole-transporting substance in each layer can be strictly controlled to a predetermined level, and a process for the preparation of this organic photosensitive material.

Still another object of the present invention is to provide a process in which a laminated photosensitive material as set forth above can be easily prepared by forming respective layers of the laminate independently by dip coating.

In accordance with one aspect of the present invention, there is provided an organic laminated photosensitive material of the positive charging type comprising an electroconductive substrate, a charge-transporting layer formed on the substrate and a charge-generating and transporting layer formed on the charge-transporting layer, wherein the charge-transporting layer is composed of a binder resin containing a hole-transporting substance, the charge-generating and transporting layer is composed of a binder resin containing a charge-generating substance and a hole-transporting substance, the hole-transporting substance in the charge-generating and transporting layer is different from the hole-transporting substance in the charge-transporting layer, and the oxidation potential of the hole-transporting substance in the charge-generating and transporting is higher than the oxidation potential of the hole-transporting substance in the charge-transporting layer but the difference of the oxidation potential between the hole-transporting substances in both the layers is smaller than 0.3 eV.

In accordance with another aspect of the present invention, there is provided a process for the preparation of an organic laminated photosensitive material of the positive charging type, which comprises coating an electroconductive substrate with a solution of a binder resin and a hole-transporting substance in an organic solvent, drying the coated solution to form a charge-transporting layer, coating the charge-transporting layer with a coating liquid formed by dissolving a binder resin and a hole-transporting substance in an organic solvent and dispersing a charge-generating substance in the solution and drying the coating liquid to form a charge-generating and transporting layer, wherein the hole-transporting substance of the charge-generating and transporting layer has a lower organic value/inorganic value ratio than that of the hole-transporting substance of the charge-transporting layer, the oxidation potential of the hole-transporting substance of the charge-generating and transporting layer is higher than the oxidation potential of the hole-transporting substance of the charge-transporting layer but the difference of the oxidation potential between the two hole-transporting substances of both the layers is smaller than 0.3 eV, and an organic solvent capable of dissolving the hole-transporting substance of the charge-generating and transporting layer but incapable of dissolving the hole-transporting substance of the charge-transporting layer is used as the organic solvent of the coating liquid for formation of the charge-generating and transporting layer.

DETAILED DESCRIPTION OF THE PREFERRED EMBODIMENTS

Figure 1:
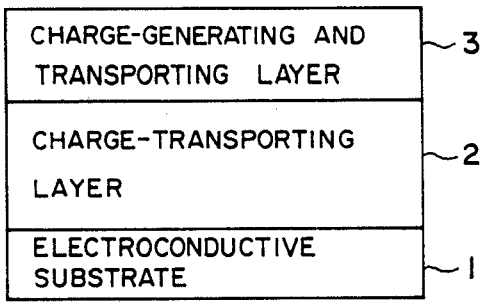
FIG. 1 is a diagram illustrating the sectional structure of the organic laminated photosensitive material of the positive charging type according to the present invention.

Referring to FIG. 1 illustrating the sectional structure of the organic laminated photosensitive material of the positive charging type according to the present invention, this photosensitive material comprises an electroconductive substrate 1, a charge-transporting layer 2 formed on the substrate and a charge-generating and transporting layer 3 formed on the charge-transporting layer. The charge-transporting layer 2 is composed of a binder resin containing a hole-transporting substance ($CTM_1$), and the charge-generating and transporting layer 3 is composed of a binder containing a charge-generating substance (CGM) and a hole-transporting substance ($CTM_2$) at a specific ratio described hereinafter.

If this photosensitive material is positively charged and exposed to light imagewise, holes generated in the charge-generating and transporting layer 3 are moved in the layer 3 by the hole-transporting substance ($CTM_2$) contained in the layer 3 and injected into the charge-transporting layer 2 and are moved in the layer 2 by the hole-transporting substance ($CTM_1$) and are cancelled by the negative polarity of the substrate to form an electrostatic image.

In the production of the laminated photosensitive material of the present invention, a solution of the binder resin and hole-transporting substance ($CTM_1$) in an organic solvent is prepared, and the solution is coated and dried on the surface of the electroconductive substrate 1 to form a charge-transporting layer 2. Separately, a different hole-transporting substance ($CTM_2$) is dissolved in an organic solvent and the charge-generating substance is dispersed in the solution to form a coating liquid, and the coating liquid is coated and dried on the charge-transporting layer 2 to form a charge-generating and transporting layer 3.

In the present invention, the first requirement is that the hole-transporting substance ($CTM_2$) in the charge-generating and transporting substance ($CTM_1$) in the charge-transporting layer 2 are different from each other, and if this requirement is satisfied, the dissolution of $CTM_1$ is prevented at the time of forming the charge-generating and transporting layer 3 by coating.

In the case where $CTM_2$ of the layer 3 is made different from $CTM_1$ of the layer 2, it is an important question whether injection of holes into the layer 2 from the layer 3 can be easily performed. According to the present invention, by making the oxidation potential, that is, the energy level, of $CTM_2$ higher than that of $CTM_1$, injection of holes into the layer 2 from the layer 3 can be easily performed and the sensitivity of the final sensitive material is increased. However, if the difference of the oxidation potential between $CTM_1$ and $CTM_2$ exceeds 0.3 eV, matching between $CTM_1$ and $CTM_2$ is degraded and the sensitivity of the final photosensitive material is rather degraded. In the present invention, it is preferred that the difference of the oxidation potential between the hole-transporting substance ($CTM_2$) of the charge-generating and transporting layer and the hole-transporting substance ($CTM_1$) of the charge-transporting layer be 0 to 0.3 eV. In order to prevent the dissolution of $CTM_1$ at the time of formation of the charge-generating and transporting layer 3, it is preferred that the hole-transporting substance ($CTM_1$) of the charge-transporting layer be a hole-transporting substance having an organic value/inorganic value ratio of at least 1.9 and the hole-transporting substance ($CTM_2$) of the charge-generating and transporting layer be a hole-transporting substance having an organic value/inorganic value ratio lower than 1.8.

In the instant specification, the organic value/inorganic value ratio is calculated from organic and inorganic value of organic compounds shown in Region of Chemistry, Oct. 1957 (Vol, 11, No. 10), pages 719 through 725. This ratio indicates the balance between organic and inorganic properties and has a relation to the analogousness, especially the solubility or compatibility, of a substance. For example, a good solubility is attained in a combination of a hole-transporting substance and an organic solvent, which have organic value/inorganic value ratios close to each other, and if the ratios greatly differ, no good solubility is attained.

In the present invention, $CTM_1$ and $CTM_2$ are selected so that the organic value/inorganic value ratio of $CTM_2$ is lower than that of $CTM_1$, and a solvent capable of dissolving $CTM_2$ but incapable of dissolving $CTM_1$ is used for formation of a coating liquid for preparing the charge-generating and transporting layer, whereby the dissolution of $CTM_1$ can be prevented.

Electroconductive Substrate

The electroconductive substrate may be in the form of a sheet or a drum. A substrate which is electrically conductive by itself and a sufficient mechanical strength during the use are preferred. Various materials having an electric conductivity can be used as the electroconductive substrate. For example, there can be mentioned single layers of metals such as aluminum, an aluminum alloy, copper, tin, platinum, gold, silver, vanadium, molybdenum, chromium, cadmium, titanium, nickel, palladium, indium, stainless steel and brass, or the electroconductive resin composition containing the above-mentioned electroconductive materials and plastic materials and glass sheets having layers of the above-mentioned metals, indium oxide, tin oxide, carbon and the like formed by vacuum deposition or the like.

Charge-Transporting Layer

In the present invention, the charge-transporting layer formed on the electroconductive substrate is composed of a binder resin containing a hole-transporting substance, as described hereinbefore. Any of known hole-transporting substances can be used without any limitation as the hole-transporting substance ($CTM_1$) to be contained in the charge-transporting layer. Preferred examples are shown in Table 1. Incidentally, the organic value/inorganic value ratios of these compounds are shown in Table 1.

TABLE 1

| Hole-Transporting Substance | Organic Value/Inorganic Value Ratio |
|---|---|
| poly-N-vinylcarbazole | 2.8 |
| phenanthrene | 2.7 |
| N-ethylcarbazole | 2.8 |
| 2,5-diphenyl-1,3,4-oxadiazole | 1.4 |
| 2,5-bis-(4-diethylaminophenyl)-1,3,4-oxazole | 1.3 |
| 4,4-bis(diethylamino-2,2'-dimethyl-triphenyl)methane | 3.0 |
| 2,4,5-triaminophenylimidazole | 1.2 |
| 2,5-bis(4-diethylaminophenyl)-1,3,4-triazole | 1.1 |
| 1-phenyl-3-(4-diethylaminostyryl)-5-(4-diethylaminophenyl)-pyrazoline | 1.9 |
| p-diethylaminobenzaldehydo-(diphenylhydrazone) | 1.8 |
| N-ethylcarbazole-3-carbaldehydo-diphenylhydrazone | 2.0 |
| N,N,N',N'-tetraphenylbenzidine | 3.0 |
| 1,1-diphenyl-4,4-di-N-diethyl-p-anilyl-1,3-butadiene | 3.4 |
| N,N,N',N'-tetrakis(4-tolyl)-2,5-dimethylbenzidine | 3.7 |
| N,N'-diphenyl-N,N'-bis(2,4-dimethyl-phenyl)benzidine | 3.6 |
| N,N,N',N'-tetrakis(3-tolyl)-3,5-phenylene-diamine | 3.2 |
| N-methylcarbazole-3-carbaldehydodiphenylhydrazone | 1.9 |
| N,N'-diphenyl-N,N'-ditoluylbenzidine | 3.3 |
| N,N,N'N'-tetraphenylbenzidine | 3.1 |

Of these hole-transporting substances, those having an organic value/inorganic value ratio of at least 1.9 are preferably used.

Various resins can be used as the binder resin. For example, there can be mentioned a styrene polymer, a styrene/butadiene copolymer, a styrene/acrylonitrile copolymer, a styrene/acrylic acid copolymer, an acrylic polymer, a styrene/acrylic copolymer, an ethylene/vinyl acetate copolymer, polyvinyl chloride, a vinyl chloride/vinyl acetate copolymer, polyvinyl chloride, a vinyl chloride/vinyl acetate copolymer, a polyester, an alkyd resin, a polyamide, a polyurethane, an epoxy resin, a polycarbonate, a polyarylate, a polysulfone, a diallyl phthalate resin, a silicone resin, a ketone resin, a polyvinyl butyral resin, polyether resin, a phenolic resin, and photo-curing resins such as an epoxy acrylate and a urethane acrylate. Incidentally, a photoconductive polymer such as poly-N-vinylcarbazole can be also be used as the binder resin.

It is preferred that in the charge-transporting layer, the hole-transporting substance be present in an amount of 50 to 300% by weight, especially 75 to 200% by weight, based on the binder resin. Furthermore, it is preferred that the thickness of the charge-transporting layer be 5 to 40 μm, especially 10 to 30 μm.

Charge-Generating and Transporting Layer

The charge-generating and transporting layer formed on the above-mentioned charge-transporting layer is composed of a binder resin containing a charge-generating substance and a hole-transporting substance.

The above-mentioned hole-transporting substances can be used as the hole-transporting substance ($CTM_2$) to be contained in the charge-generating and transporting layer, so far as $CTM_2$ is different from $CTM_1$ and the above-mentioned requirement of the oxidation potential is satisfied. $CTM_2$ having a lower organic value/inorganic value ratio lower than that of $CTM_1$, especially lower than 1.8, is preferably used.

Known charge-generating substances can be used for the charge-generating and transporting layer without any limitation. For example, there can be used pyrylium salts, azo pigments, phthalocyanine pigments, indigo pigments, triphenylmethane pigments, threne pigments, toluidine pigments, pyrazoline pigments, perylene pigments, quinacridone pigment and dibromoanthanthrone.

From the viewpoint of the sensitivity of the photosensitive material, it is preferred that in the charge-generating and transporting layer, the concentration of the charge-generating substance be 10 to 1% by weight, especially 6 to 2% by weight, based on the sum of the hole-transporting substance and the binder resin. Furthermore, it is preferred that the charge-generating substance and the hole-transporting substance be present at a weight ratio of from 1/3.5 to 1/40, especially from 1/5 to 1/20.

Furthermore, it is preferred that the thickness of the charge-generating and transporting layer be 5 to 30 μm, especially 10 to 20 μm. If the thickness is too small, reduction of the surface saturation voltage, reduction of the sensitivity and reduction of the printing resistance are readily caused. If the thickness is too large, the sensitivity is often reduced.

Preparation of Laminated Photosensitive Material

In the production of the laminated photosensitive material of the present invention, a solution of the binder resin and hole-transporting substance in an organic solvent is prepared, and the solution is coated and dried on the surface of the electroconductive substrate to form a charge-transporting layer. Furthermore, the binder resin and hole-transporting substance are dissolved in an organic solvent and the charge-generating substance is dispersed in the solution to form a coating liquid, and the coating liquid is coated and dried on the charge-transporting layer to form a charge-generating and transporting layer.

An organic solvent capable of dissolving the hole-transporting substance ($CTM_1$) of the charge-transporting layer is used for the coating liquid for formation of the charge-transporting layer. For example, when N-ethylcarbazole-3-carbaldehydodiphenylhydrazone (organic value/inorganic value ratio=2.0) is used as $CTM_1$, an organic solvent having an organic value/inorganic value ratio of at least 2.0, for example, mineral terpene, xylene, dichloromethane, dioxane or tetrahydrofuran, is used. An organic solvent capable of dissolving the hole-transporting substance ($CTM_2$) of the charge-generating and transporting layer but incapable of dissolving the hole-transporting substance ($CTM_1$) of the charge-transporting layer is used for the coating liquid for formation of the charge-generating and transporting layer. For example, when N-ethylcarbazole-diphenylhydrazone is used as $CTM_1$ and diethylaminobenzaldehydodiphenylhydrazone (organic value/inorganic value=1.8) is used as $CTM_2$, an organic solvent having an organic value/inorganic value ratio of 1.9 to 0.6, for example, methylethylketone, methylisobutylketone, acetonitrile, diethyleneglycol methyl ether or n-propyl acetate, is preferred. However, combinations that can be adopted in the present invention are not limited to those mentioned above. It is preferred that at the time of dip coating, the solid concentration in the coating liquid be adjusted to 5 to 20% by weight.

The present invention will now be described in detail with reference to the following example that by no means limits the scope of the invention.

EXAMPLE

In tetrahydrofuran were dissolved 7.5 parts by weight of a hole-transporting substance shown below and 10 parts by weight of a polycarbonate resin (bisphenol Z type), and the solution was coated and dried on an aluminum foil to form a charge-transporting layer.

Then, a solution comprising 1 part by weight of anthanthrone bromide, 7.5 parts by weight of a hole-transporting substance shown below and 10 parts by weight of an acrylic resin (polymethyl methacrylate supplied under the tradename of "BR-101" supplied by Mitsubishi Rayon) was despersed for 10 hours by a ball mill to form a coating liquid for formation of a charge-generating and transporting layer.

The so-formed coating liquid was coated and dried on the above-mentioned charge-transporting layer, whereby a photosensitive layer having a laminate structure was obtained.

The following hole-transporting substances were used. DEH:

p-Diethylaminobenzaldehydodiphenylhydrazone of the following formula:

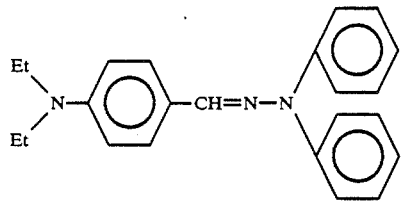

MKH:

N-Methylcarbazole-3-carbaldehydodiphenylhydrazone of the following formula:

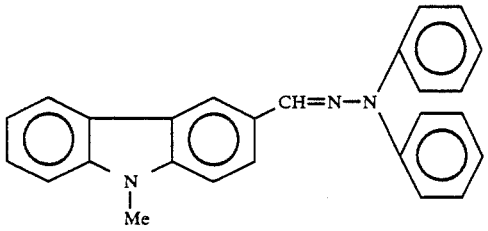

EKH:

N-Ethylcarbazole-3-carbaldehydodiphenylhydrazone of the following formula:

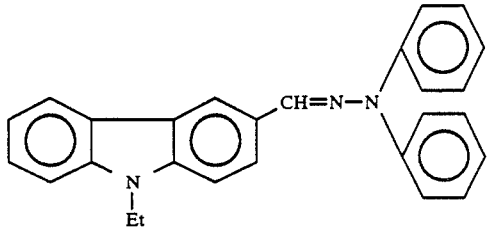

TPD:

N,N'-Diphenyl-N,N'-ditoluylbenzideine of the following formula:

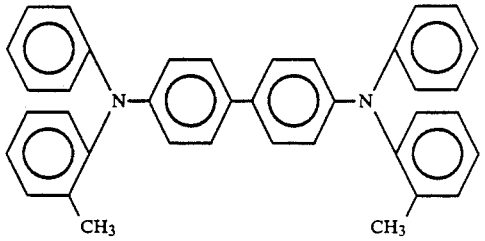

PED:

1,1-Diphenyl-4,4'-di-N-diethyl-p-anilyl-1,3-butadiene of the following formula:

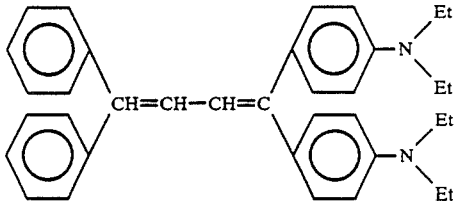

The solubility of the hole-transporting substance in the solvent, the organic value/inorganic value ratio and the oxidation potential are shown in Table 2.

Laminated photosensitive materials were prepared by using seven combinations of the hole-transporting substances shown in Table 3. When the hole-transporting substance of the charge-generating and transporting substance was DEH, MEK (methylethylketone) was used as the solvent of the coating liquid for formation of the charge-generating and transporting layer, and in case of other hole-transporting substances, tetrahydrofuran was used as the solvent.

The so-obtained electrophotographic photosensitive material was attached to an electrostatic tester (Model SP-428 supplied by Kawaguchi Denki Seisakusho), and the following properties were tested.

More specifically, a voltage of +5.5 KV was applied to a charger and the photosensitive layer was electrified for 2 seconds by corona discharge, and the photosensitive layer was allowed to stand still for 2 seconds (the voltage at this point is designated as "$V_o$"). Then, the photosensitive layer was irradiated with light of a tungsten lamp so that the illuminance on the surface of the photosensitive layer was 10 lux, and the light exposure quantity ($E_{\frac{1}{2}}$) required for attenuating the surface voltage of the photosensitive layer to ½ was measured. Furthermore, after 6 seconds' light exposure, the surface voltage (residual voltage) was determined.

In runs 1 through 4, the same hole-transporting substance was used for the charge-transporting layer and the charge-generating and transporting layer or a hole-transporting substance having a lower oxidation potential was used for the charge-transporting layer. Even if a hole-transporting substance having an oxidation potential lower by 0.1 eV was used, the charging characteristics and half-value light exposure quantity were not substantially changed. However, when a hole-transporting substance having an oxidation potential lower by 0.3 eV was used, the sensitivity was reduced because of a low efficiency of injection of charges.

When run 4 was compared with comparative run 2, it was seen that in comparative run 2, since the oxidation potential of the hole-transporting substance of the charge-generating and transporting substance was lower than the oxidation potential of the hole-transporting substance of the charge-transporting layer, the charge injection efficiency was further lowered, and the sensitivity was further reduced.

Of the above-mentioned five hole-transporting substances, only DEH has a relatively low organic value/inorganic value ratio and is soluble in a solvent having a low organic value/inorganic value ratio.

Accordingly, only DEH is a hole-transporting substance suitable for the charge-generating and transporting layer, and the oxidation potential of DEH is low and 0.32 eV. Therefore, in run 5, a photosensitive material was prepared by using PED having a further lower oxidation potential for charge-transporting layer.

It is seen that the sample obtained in this run was an excellent photographic photosensitive material having good charging characteristics and high sensitivity. In this photosensitive material, the charge-transporting layer was composed of the polycarbonate resin (bisphenol Z type) and PED, each of which is insoluble in such a solvent as methylethylketone or acetonitrile, and the charge-generating and transporting layer was composed of the acrylic resin (BR-101 supplied by Mitsubishi Rayon) and DEH, each of which is soluble in methylethylketone or acetonitrile. Therefore, even if the dip coating method was adopted, a photosensitive material having a laminate structure could be easily prepared without corrosion of the lower layer.

TABLE 2

| | xylene | dichloromethane | tetrahydrofuran | dioxane | methylethylketone | acetonitrile | diethyleneglycol methyl ether | isopropanol | organic value/inorganic value ratio | oxidation potential (eV) |
|---|---|---|---|---|---|---|---|---|---|---|
| DEH | O | O | O | O | O | O | O | X | 1.8 | 0.32 |
| MKH | O | O | O | O | X | X | X | X | 1.9 | 0.61 |
| EKH | O | O | O | O | X | X | X | X | 2.0 | 0.62 |
| TPD | O | O | O | O | X | X | X | X | 3.3 | 0.51 |
| PED | O | O | O | O | X | X | X | X | 3.4 | 0.28 |
| organic value/inorganic value ratio | 10.0 | 5.0 | 2.67 | 2.0 | 1.23 | 0.86 | 0.86 | 0.50 | | |

Note
O: dissolved
X: not dissolved

TABLE 3

| | Hole-Transporting Substance (charge-generating and transporting layer/charge-transporting layer) | Oxidation Potential (eV) (charge-generating and transporting layer/charge-transporting layer) | Initial Characteristics | | |
|---|---|---|---|---|---|
| | | | initial voltage (V) | half-value light exposure quantity (lux · sec) | residual voltage (V) |
| run 1 | EKH/EKH | 0.62/0.62 | 740 | 6.2 | 20 |
| run 2 | EKH/MKH | 0.62/0.61 | 740 | 6.0 | 20 |
| run 3 | EKH/TPD | 0.62/0.51 | 800 | 5.8 | 20 |
| run 4 | EKH/DEH | 0.62/0.32 | 660 | 7.5 | 30 |
| run 5 | DEH/PED | 0.32/0.28 | 680 | 6.0 | 25 |
| comparative run 1 | PED/DEH | 0.28/0.32 | 690 | 7.3 | 40 |
| comparative run 2 | DEH/EKH | 0.32/0.62 | 700 | 8.8 | 40 |

We claim:

1. A process for the preparation of an organic laminated photosensitive material of the positive charging type, which comprises coating an electroconductive substrate with a solution of a binder resin and a hole-transporting substance in an organic solvent, drying the coated solution to form a charge-transporting layer, coating the charge-transporting layer with a coating liquid formed by dissolving a binder resin and a hole-transporting substance in an organic solvent and dispersing a charge-generating substance in the solution and drying the coating liquid to form a charge-generating and transporting layer, wherein the hole-transporting substance of the charge-generating and transporting layer has a lower organic value/inorganic value ratio than that of the hole-transporting substance of the charge-generating layer, the oxidation potential of the hole-transporting substance of the charge-generating and transporting layer is higher than the oxidation potential of the hole-transporting substance of the charge-transporting layer but the difference of the oxidation potential between the two hole-transporting substances of both the layers is smaller than 0.3 eV, and an organic solvent capable of dissolving the hole-transporting substance of the charge-generating and transporting layer but incapable of dissolving the hole-transporting substance of the charge-transporting layer is used as the organic solvent of the coating liquid for formation of the charge-generating and transporting layer.

* * * * *